US006747533B2

(12) United States Patent
Rakus et al.

(10) Patent No.: US 6,747,533 B2
(45) Date of Patent: Jun. 8, 2004

(54) ONE PIECE AIR-CORE COIL MOUNTING BRACKET

(75) Inventors: Paul Richard Rakus, Beaver Falls, PA (US); Thomas Clements Pendrick, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 200 days.

(21) Appl. No.: 09/975,793

(22) Filed: Oct. 11, 2001

(65) Prior Publication Data

US 2003/0071701 A1 Apr. 17, 2003

(51) Int. Cl.[7] ..... H01H 83/00
(52) U.S. Cl. ..... 335/16
(58) Field of Search ..... 335/147, 195, 335/127–130; 218/22

(56) References Cited

U.S. PATENT DOCUMENTS 2,471,608 A * 5/1949 Caswell ..... 200/244
4,229,630 A * 10/1980 Wafer et al. ..... 218/149
5,210,385 A * 5/1993 Morel et al. ..... 218/9
5,818,671 A * 10/1998 Seymour et al. ..... 361/42
5,886,606 A * 3/1999 Tosaka et al. ..... 335/172
5,943,204 A 8/1999 Jones et al.
5,969,314 A 10/1999 Rakus et al.
6,005,206 A 12/1999 Rakus et al.
6,232,570 B1 * 5/2001 Castonguay et al. ..... 218/146
6,376,788 B1 * 4/2002 Jones et al. ..... 200/244
6,417,474 B1 * 7/2002 Rakus et al. ..... 218/148

* cited by examiner

*Primary Examiner*—Lincoln Donovan
*Assistant Examiner*—Bernard Rojas
(74) *Attorney, Agent, or Firm*—Martin J. Moran

(57) ABSTRACT

A mounting bracket for a circuit breaker air-core coil includes a unitary body having a generally U-shaped body. The body has at least one retaining form structured to fit over a fastener head. When installed in a typical power air circuit breaker, the air-core coil disposed in the mounting bracket is located above the circuit breakers's load conductor fasteners. These fasteners, and therefore the air-core coil, are located outside of the space in the circuit breaker occupied by a current sensor.

12 Claims, 5 Drawing Sheets

ONE PIECE AIR-CORE COIL MOUNTING BRACKET

BACKGROUND OF THE INVENTION

1. Field of the Invention

This invention relates to an air-core coil for sensing the current in a circuit breaker and, more specifically, to a unitary body mounting bracket for the air-core coil.

2. Background Information

A common type of power air circuit breaker has a molded casing housing and multiple pole assemblies all driven by a common operating, or trip, mechanism. Contact arm carriers support movable contacts which engage stationary contacts when the contact arm carrier is in the closed position. The movable contact is in electrical communication with a load conductor which extends through the housing. Additionally, the load conductor is attached by a fastener to the housing. The stationary contact is in communication with a line conductor which extends through the housing. The line conductor is structured to be coupled to an electrical source. The load conductor is structured to be coupled to an end use that relies on electricity.

Traditionally, power air circuit breakers using an electronic trip device have included both a primary current sensor and a secondary current sensor. The primary current sensor may be a toroidal current sensor disposed about the load conductor. The optional secondary current sensor is an air-core coil. Both the primary and secondary sensors are coupled to an electronic trip unit that is structured to detect an over-current condition and, when an over-current occurs, actuate the trip mechanism in the circuit breaker.

As shown in FIG. 1, a prior art air-core sensor assembly includes an air core coil 1 and a mounting bracket 3. The air-core coil mounting bracket 3 included a metal portion 4 and an insulated portion 5. The metal portion 4 was an elongated body that attached to the load conductor fastener 6. Although the load conductor fastener 6 is not disposed within the perimeter of the toroidal current sensor 7, the metal portion 4 of the bracket extended along the load conductor 2 so that the air-core coil was disposed within the perimeter of the toroidal current sensor 7. That is, the air-core coil 1 was disposed adjacent to the fastener 6 head, not above the fastener 6 head. This configuration required the toroidal current sensor 7 to have an inner radius large enough to accommodate the air-core coil 1.

There is a trend toward smaller circuit breakers. With a smaller circuit breaker, the radius of the toroidal current sensor must be reduced, thereby eliminating the space in which the air-core sensor assembly is disposed. Thus, the former, two-part mounting bracket cannot be used with newer circuit breakers. Additionally, the two-piece mounting bracket required assembly which added an additional manufacturing step and cost.

There is, therefore, a need for an air-core sensor assembly mounting bracket that is made from one piece.

There is a further need for an air-core sensor assembly mounting bracket that is not structured to mount the air-core sensor within the perimeter of the toroidal current sensor.

There is a further need for an air-core sensor assembly mounting that is compatible with existing circuit breaker hardware.

SUMMARY OF THE INVENTION

These needs, and others, are met by the present invention which provides a unitary body, i.e., one-piece, mounting bracket having a U-shaped body and at least one retaining form. The retaining form is structured to be coupled to a fastener on the load conductor. The retaining form is located below the U-shaped body. That is, the U-shaped body has a longitudinal axis and the retaining form is located substantially below the longitudinal axis.

Thus, when the mounting bracket is attached to a fastener coupling the load conductor to the circuit breaker housing, and an air-core coil is disposed within the U-shaped body, the air-core coil will be disposed, generally, above the fastener heads. Because the fastener heads are not within the perimeter of the toroidal current sensor, the air-core coil will be located outside of the toroidal current sensor perimeter. Accordingly, because the air-core coil is not disposed within the perimeter of the toroidal current sensor, the toroidal current sensor can have an inner radius and, therefore the outer radius as well, that is closer to the load conductor than prior art toroidal current sensors. Because the volume occupied by the toroidal current sensor is smaller, the circuit breaker may be made smaller too.

An added advantage of the unitary body mounting bracket is that, it is less expensive to manufacture and is easier to install than the prior art two-piece mounting bracket.

BRIEF DESCRIPTION OF THE DRAWINGS

A full understanding of the invention can be gained from the following description of the preferred embodiments when read in conjunction with the accompanying drawings in which:

FIG. 4A is a top view, FIG. 4B is an elevational view, FIG. 4C is a bottom view, FIG. 4D is a cross-sectional, side view, and FIG. 4E is a cross-sectional front view.

DESCRIPTION OF THE PREFERRED EMBODIMENTS

As used herein, directional terms, e.g. "above" and "below" are used for convenience relative to the Figures and are not intended to limit the claims.

Figure 1:
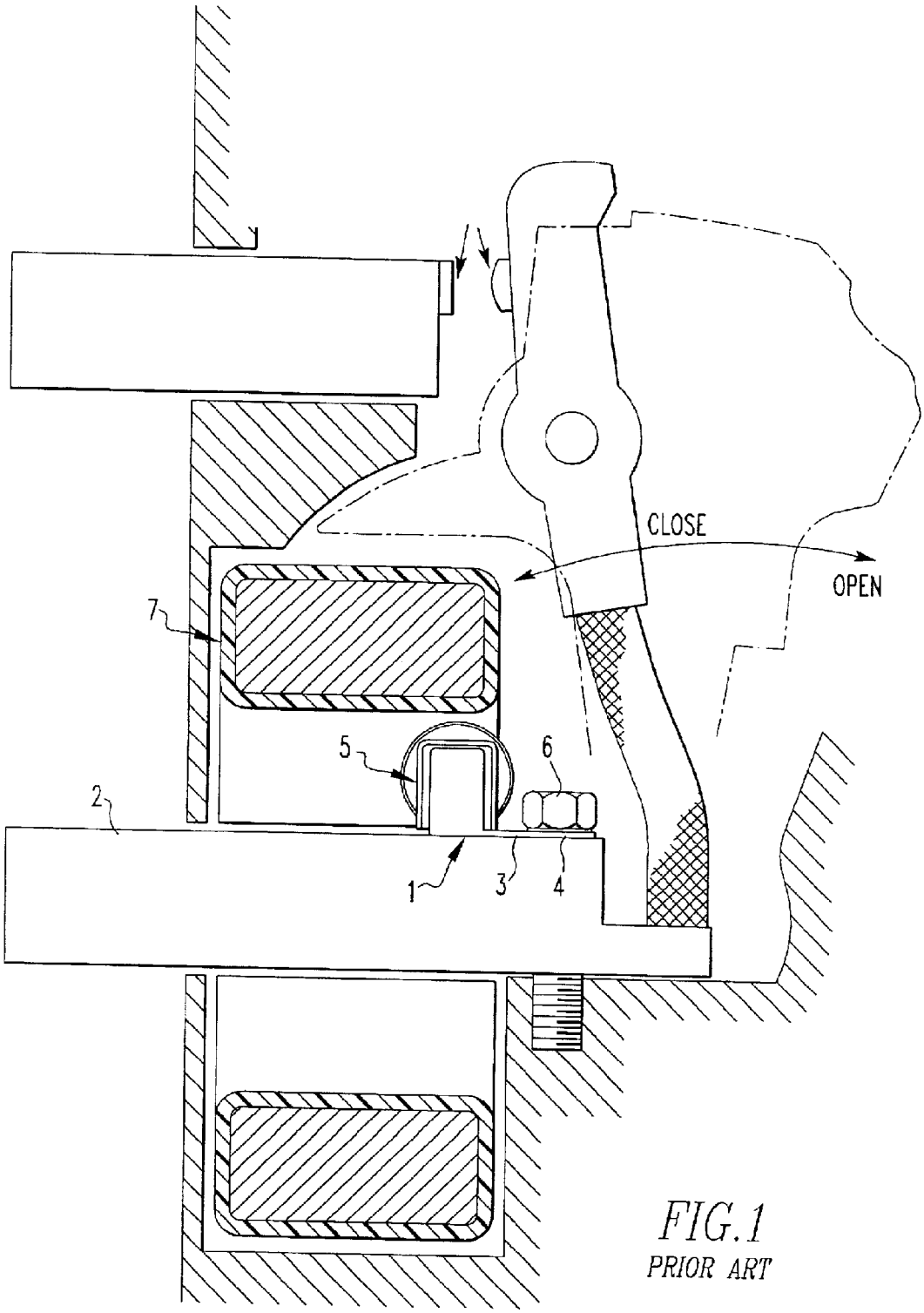
FIG. 1 PRIOR ART
FIG. 1 is a cross-sectional view of the prior art air-core coil assembly within a circuit breaker.
Figure 2:
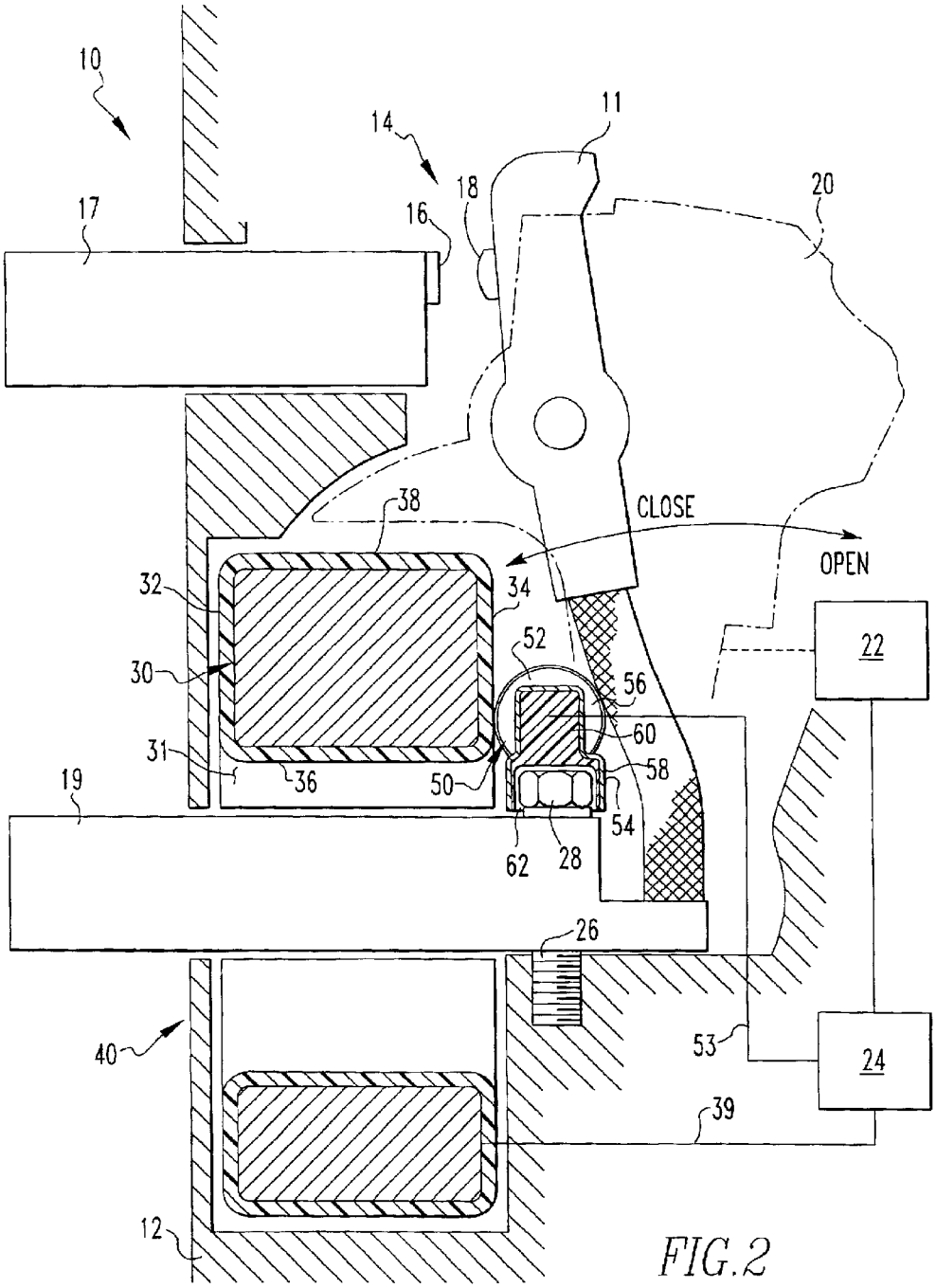
FIG. 2 is a cross-sectional view of the present invention within a circuit breaker.
Figure 3:
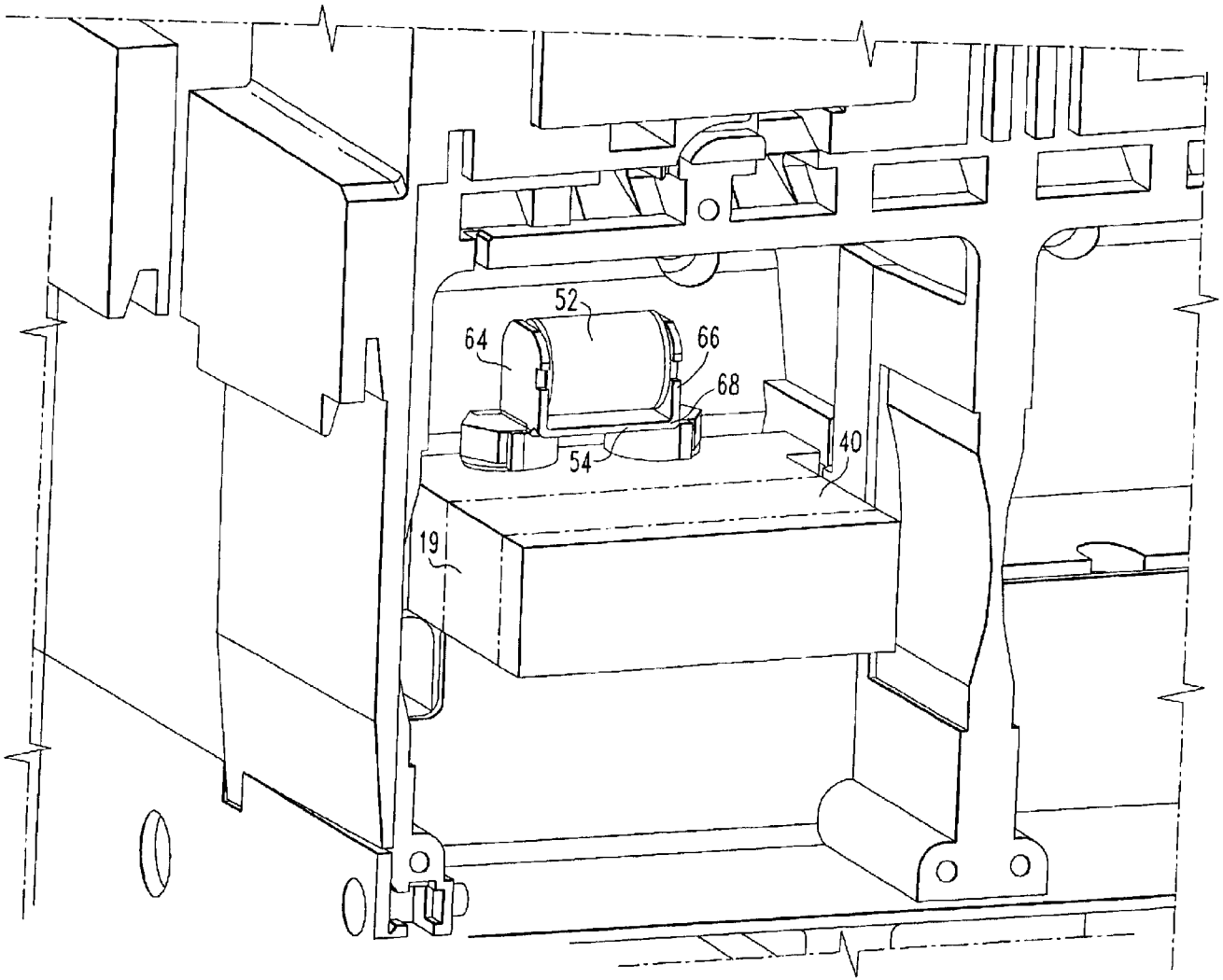
FIG. 3 is an isometric view of the present invention in a circuit breaker, with the toroidal current sensor removed.

As shown in FIG. 2, a circuit breaker 10 includes a housing 12 and at least one set of main contacts 14. The main contacts 14 include a stationary contact 16 and at least one movable contact 18. Typically, there is a plurality of movable contacts 18, each movable contact 18 located on one of a plurality of conductive fingers 11. The stationary contact 16 is in electrical communication with a line conductor 17. The line conductor 17 extends through the housing 12. The movable contact 18 is in electrical communication with an elongated load conductor 19. The load conductor 19 extends through the housing 12. The line conductor 19 is coupled to the housing 12 by at least one fastener 26, such as, but not limited to, a bolt. The fastener 26 has a head 28. Preferably, there are two fasteners 26. The movable contact 18 is attached to a contact arm carrier 20. The contact arm carrier is coupled to an operating mechanism 22 (shown schematically and which is fully disclosed in U.S. Pat. No. 6,005,206, assigned to the assignee of this application and incorporated by reference) which is structured to move the main contacts 14 into, and out of, contact with each other. Such movement may be accomplished by manually tripping the mechanism 22, or may be in response to an over-current condition. The circuit breaker 10 also includes an electronic trip unit 24 (shown schematically) that is structured to actuate the operating mechanism when an over-current condition is sensed.

Sensing an over-current condition is accomplished by one or more sensors including a toroidal current sensor 30 having a central opening 31. The toroidal current sensor 30 is the primary sensor for detecting over-current conditions. The toroidal current sensor 30 is disposed within the housing 12 and is disposed about the load conductor 19. That is, the load conductor 19 passes through the central opening 31 of the toroidal current sensor 30. The toroidal current sensor 30 has a generally rectangular cross-sectional area. Thus, the toroidal current sensor 30 has an outer side 32, an inner side 34, an inner radius 36 and an outer radius 38. The area defined by the outer side 32, the inner side 34 and the outer radius 38, including the area of the central opening 31, is the primary sensor space 40. The fastener 26 for the load conductor 19 is disposed adjacent to, and not within, the primary sensor space 40. The toroidal current sensor 30 is a transformer which, as is well know in the prior art, provides a signal to the electronic trip unit 24 via wire 39.

Sensing an over-current condition is also accomplished by a secondary sensor, an air-core coil assembly 50. The air-core coil assembly 50 includes an air-core coil 52 and a mounting bracket 54. The air-core coil 52 has a hollow, generally cylindrical body 56. The air-core coil 52 provides a signal, via wire 53, to the electronic trip unit 24.

Figure 4A:
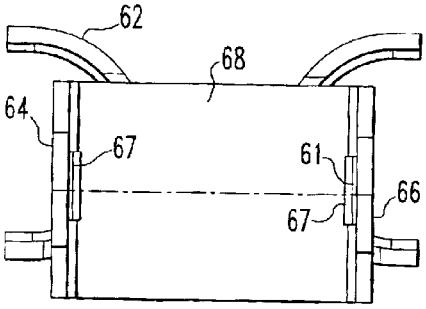
FIGS. 4A–4E are planar views of the present invention. Specifically.
Figure 4B:
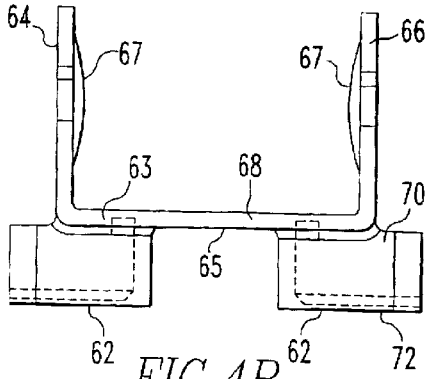
Figure 4C:
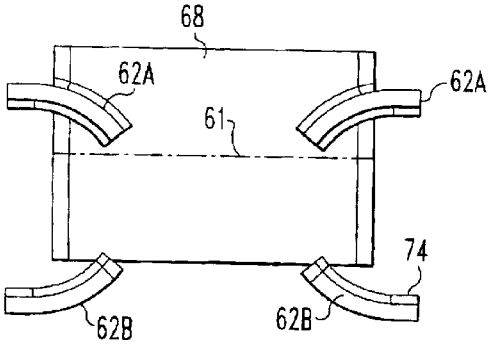
Figure 4D:
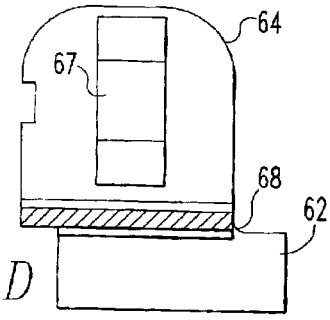
Figure 4E:
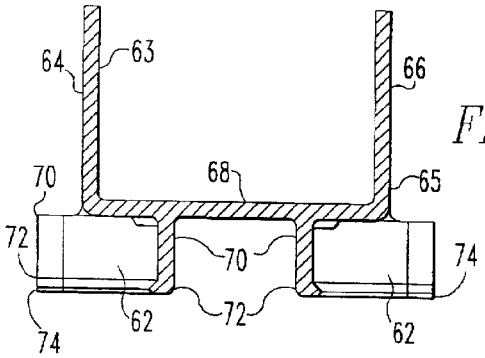

The mounting bracket includes a unitary body 58 having a U-shaped portion 60 and at least one retaining form 62. As shown in FIGS. 3 and 4A–4E, the U-shaped body 60 has a first side member 64, a second side member 66 and an elongated bottom member 68. As shown in FIG. 4A, a longitudinal axis 61 extends across the first side member 64, the second side member 66 and the elongated bottom member 68. The U-shaped portion 60 has an inner side 63 and an outer side 65. Both the first side member 64 and the second side member 66 have an raised, generally arcuate ridge 67 on the inner side 63. The arcuate ridge 67 is structured to fit at least partially within the air-core coil hollow, generally cylindrical body 56. The body 58 is made from a resilient, flexible material. Thus; both the first side member 64 and the second side member 66 may flex outwardly. By flexing both the first side member 64 and the second side member 66 outwardly, the air-core coil 52 may be placed between the first side member 64 and the second side member 66 with the ridges 67 disposed at least partially within the air-core coil hollow, generally cylindrical body 56. In this manner, the body 58 is structured to snap-fit hold the air-core coil 52.

The retaining form 62 is, in one embodiment, a partial arc shaped structure having at least two segments, 62A and 62B. Preferably, there is one retaining form 62 for each load conductor fastener 26. Thus, there are preferably two retaining forms 62. As best shown on FIG. 4C, the arc formed by arc segments 62A and 62B open outwardly in opposite directions. Where the fastener head 28 has corners, the arc segments 62A, 62B extend for a length sufficient to contact at least one corner on the fastener head 28, regardless of the orientation of the fastener head 28. Each retaining form 62 has a top portion 70 and a bottom portion 72. The top portion 70 is coupled to the U-shaped body outer side 65, preferably to the bottom member 68. The bottom portion 72 includes a lip 74 extending along the inner side of the arc. This lip is structured to be disposed between the load conductor 19 and the fastener head 28. The retaining form 62 is disposed below the U-shaped portion 60, as opposed to adjacent to the U-shaped portion 60. The arc segments 62A, 62B may be offset from the longitudinal axis 61 of the U-shaped portion 60. By having an offset, the air-core coil 52 may be placed closer to, but not within, the primary sensor space 40.

Figure 5:
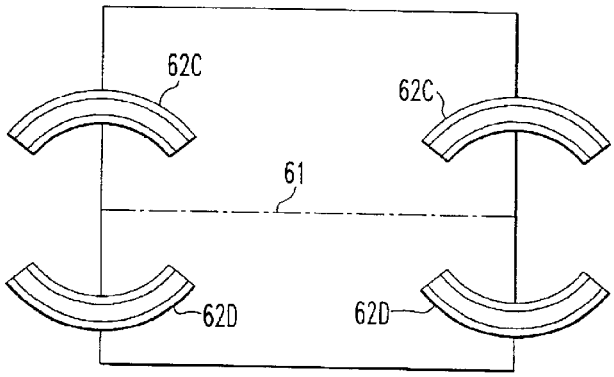
FIG. 5 is a bottom view of an alternate embodiment.
Figure 6:
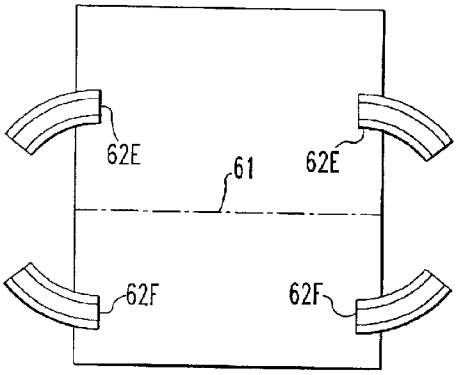
FIG. 6 is a bottom view of an alternate embodiment.
Figure 7:
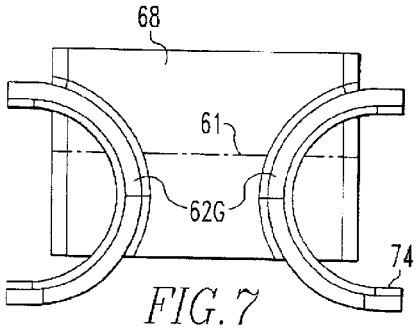
FIG. 7 is a bottom view of an alternate embodiment.

In an alternate embodiment, as shown in FIG. 5, the arc segments 62C, 62D are a pair of opposing arcs disposed about 180 degrees apart around a center point. In another alternate embodiment, shown in FIG. 6, the arc segments 62E, 62F open inwardly in opposite directions. In all other respects, the embodiment shown in FIGS. 5 and 6 are identical to the embodiment shown in FIGS. 4A–4E. In another alternate embodiment, shown in FIG. 7, the retaining forms 62 are arc shaped structures 62G extending about 180 degrees, i.e. a semi-circle, that open outwardly in opposite directions. At least a portion of the retaining form 62 extends across the longitudinal axis 61 of the U-shaped portion 60. That is, the retaining form 62 is disposed below the U-shaped portion 60, as opposed to adjacent to the U-shaped portion 60.

The air-core coil assembly 50 is structured to be coupled to the fastener head 28. When installed, the retaining form 62 is disposed over fastener head 28 with lip 74 between the fastener head 28 and the load conductor 19. Because the retaining form 62 is below the longitudinal axis of the U-shaped portion 60, when the mounting bracket 54 is installed and an air-core coil 52 is disposed in the U-shaped portion 60, the air-core coil 52 will be disposed substantially above the fastener head 28. Moreover, because fastener 26 is not within the primary sensor space 40, the air-core coil assembly 50 will not be disposed within the primary sensor space 40. Thus, the toroidal current sensor 30 can be structured with an inner radius 36 that is much closer to the load conductor 19 than prior art toroidal current sensors 7.

While specific embodiments of the invention have been described in detail, it will be appreciated by those skilled in the art that various modifications and alternatives to those details could be developed in light of the overall teachings of the disclosure. For example, the toroidal current sensor 30 could be located around the line conductor 17 as opposed to the load conductor 19. Thus, the air-core coil assembly 50 could be attached to the line conductor 17 as opposed to the load conductor 19. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a housing;

a main stationary contact disposed in said housing;

a main movable contact disposed in said housing;

an operating mechanism structured to move said main movable contact into and out of contact with said main stationary contact;

a line conductor in electrical communication with said main stationary contact;

a load conductor in electrical communication with the main movable contact;

said load conductor coupled to said housing by at least one fastener having a head;

an electronic trip unit coupled to said operating mechanism and structured to actuate said operating mechanism upon the event of an over-current condition;

a current sensor disposed about said load conductor and having an output wire coupled to said electronic trip unit;

an air-core sensor assembly having an air-core coil and a mounting bracket;

said bracket comprising:

a unitary body having generally U-shaped portion;

at least one retaining form structured to fit over said at least one fastener head; and said retaining form coupled to said unitary body.

2. The circuit breaker of claim 1, wherein:

said U-shaped portion has a first side member, a second side member, a bottom member, an inner side, an outer side, and a longitudinal axis extending across said first side, second side and bottom members;

said at least one retaining form coupled to said bottom member on said outer side and extending across said longitudinal axis; and whereby, when said mounting bracket is coupled to said load conductor fastener head, said mounting bracket is disposed substantially above the fastener head.

3. The circuit breaker of claim 1, wherein:

said at least one retaining form is arc extending having a top portion and a bottom portion;

said top portion coupled to said U-shaped portion; and said bottom portion having a retaining lip structured to fit under said at least one fastener head.

4. The circuit breaker of claim 3, wherein:

said at least one retaining form is arc segment having a top portion and a bottom portion;

said top portion coupled to said U-shaped portion; and said bottom portion having a retaining lip structured to fit under said fastener head.

5. The circuit breaker of claim 4, wherein:

said at least one retaining form includes two retaining forms; and said arc segments are disposed about 180 degree from each other about a central point.

6. The circuit breaker of claim 4, wherein:

said at least one retaining form includes two retaining forms; and said two retaining forms open inwardly in opposite directions.

7. The circuit breaker of claim 4, wherein:

said at least one retaining form includes two retaining forms; and said two retaining forms open outwardly in opposite directions.

8. The circuit breaker of claim 4, wherein:

said at least one retaining form includes two retaining forms; and said retaining forms are arcs extending about 180 degrees which open outwardly in opposite directions.

9. The circuit breaker of claim 1, wherein:

said housing defines an interior space having an outer portion adjacent to the housing, and an interior portion;

said current sensor disposed in said outer portion; and said air-core sensor assembly is disposed in said interior portion.

10. The circuit breaker of claim 1, wherein:

said current sensor has an outer side and an inner side;

said outer side disposed adjacent to said housing;

said inner side and said outer side defining a primary sensor space therebetween; and said air-core sensor assembly disposed adjacent to, but not within, said primary sensor space.

11. The circuit breaker of claim 10, wherein:

said U-shaped body has a first side member, a second side member, a bottom member and a longitudinal axis extending across said first side, second side and bottom members;

said retaining form formed on said unitary body so that a portion of said retaining form extends across said longitudinal axis; and whereby, when said mounting bracket is coupled to said load conductor fastener head, said mounting bracket is disposed substantially above the fastener head.

12. The circuit breaker of claim 11, wherein:

said retaining forms are two opposed arcs; and each said arc having a retaining lip.

* * * * *